United States Patent [19]

Nishikawa et al.

[11] Patent Number: 4,464,640

[45] Date of Patent: Aug. 7, 1984

[54] DISTRIBUTION CONSTANT TYPE FILTER

[75] Inventors: Toshio Nishikawa, Nagaokakyo; Sadahiro Tamura; Hiroshi Tamura, both of Kyoto, all of Japan

[73] Assignee: Murata Manufacturing Co., Ltd., Japan

[21] Appl. No.: 431,184

[22] Filed: Sep. 30, 1982

[30] Foreign Application Priority Data

| | | | |
|---|---|---|---|
| Oct. 2, 1981 | [JP] | Japan | 56-147529[U] |
| Oct. 2, 1981 | [JP] | Japan | 56-147530[U] |
| Oct. 2, 1981 | [JP] | Japan | 56-147531[U] |
| Dec. 28, 1981 | [JP] | Japan | 56-211595 |
| Dec. 28, 1981 | [JP] | Japan | 56-211596 |
| Dec. 28, 1981 | [JP] | Japan | 56-211597 |
| May 24, 1982 | [JP] | Japan | 57-76421[U] |
| Jul. 6, 1982 | [JP] | Japan | 57-102947[U] |
| Sep. 3, 1982 | [JP] | Japan | 57-154434 |
| Sep. 3, 1982 | [JP] | Japan | 57-154435 |

[51] Int. Cl.[3] ..... H01P 1/205; H01P 7/04

[52] U.S. Cl. ..... 333/202; 333/203; 333/206

[58] Field of Search ..... 333/202–212, 333/219–235, 245, 248

[56] References Cited

U.S. PATENT DOCUMENTS

| | | | |
|---|---|---|---|
| 3,505,618 | 4/1970 | McKee | 333/203 |
| 4,223,287 | 9/1980 | Nishikawa et al. | 333/206 |

FOREIGN PATENT DOCUMENTS

| | | | |
|---|---|---|---|
| 1199908 | 7/1980 | United Kingdom | 333/202 |

*Primary Examiner*—Marvin L. Nussbaum

*Attorney, Agent, or Firm*—Ostrolenk, Faber, Gerb & Soffen

[57] ABSTRACT

An improved distribution constant type electrical filter which is so arranged that columnar or cylindrical dielectric units each having conductive wires axially extended through it, are inserted into through openings formed in a dielectric material block and provided on their inner peripheral faces with inner electrically conductive layers for electrostatic coupling between the conductive wires and the inner electrically conductive layers.

29 Claims, 40 Drawing Figures

DISTRIBUTION CONSTANT TYPE FILTER

The present invention generally relates to an electrical filter and more particularly, to a distribution constant type filter working at a frequency range, for example, at several hundred MHz as in an application thereof to a booster of a U.H.F. TV receiver.

Conventionally, for electrical filters to be applied to a frequency range in the order of several hundred MHz, besides those employing LC resonance circuits and coaxial resonators, there has been proposed, for example, a distribution constant type filter which includes a block of dielectric material having at least two through-openings or bores formed therein side by side, at a predetermined interval therebetween, electrically conductive layers or inner conductors provided on the inner peripheral faces of said through-openings, and another electrically conductive layer or outer conductor formed at least on four side faces of said dielectric material block so as to constitute resonance units together with the intervening dielectric material, while a cavity having, for example, a circular cross section is provided in the dielectric material block between at least a pair of neighboring resonance units, with external circuits and the resonance units being electrostatically coupled to each other.

Figure 1:
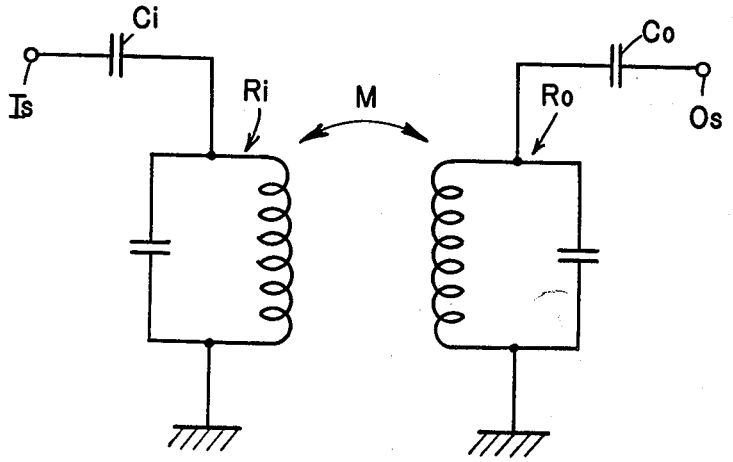
Fig. 1 PRIOR ART

More specifically, as shown in an electrical circuit diagram of FIG. 1, the known distribution constant filter referred to above has a circuit construction including input and output terminals Is and Os respectively coupled, through input and output coupling electrostatic capacities Ci and Co, to $\frac{1}{4}$ wavelength resonance circuits Ri and Ro represented as concentrated constant circuits, thus constituting an electrical filter in which the $\frac{1}{4}$ wavelength resonance circuits Ri and Ro are coupled to each other through inductive coupling, while an external circuit and the $\frac{1}{4}$ wavelength resonance circuits are also coupled to each other through electrostatic capacity coupling.

Figure 2:
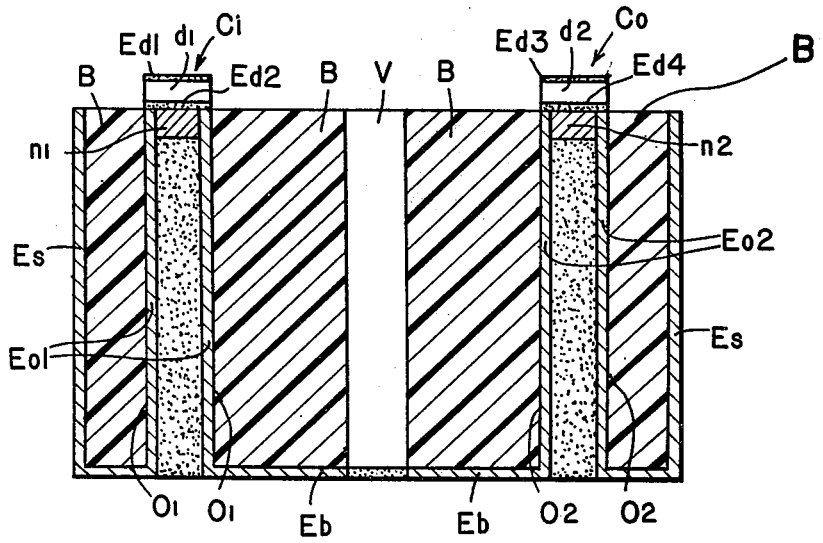
Fig. 2 PRIOR ART
Figure 3:
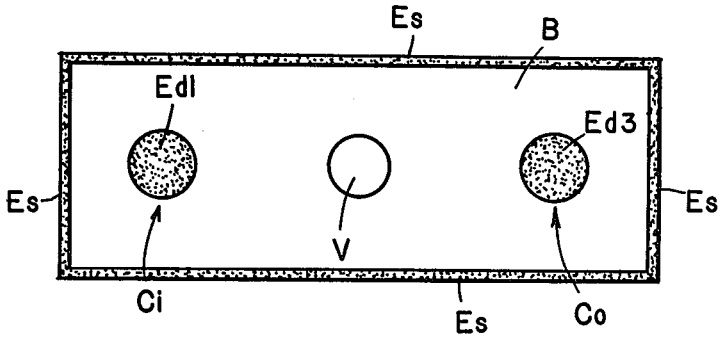
Fig.3 PRIOR ART

In one example of the specific construction as shown in FIGS. 2 and 3, the prior art distribution constant type filter generally includes a cubic box-like block B made, for example, of ceramic dielectric material of titanium oxide group, through-openings or bores 01 and 02 formed in the dielectric material block B side by side, at a predetermined interval therebetween, electrically conductive layers or inner conductors Eo1 and Eo2 respectively formed on the inner peripheral faces of the through-openings 01 and 02, and another electrically conductive layer or outer conductor Es provided at least on four side faces of said dielectric material block B. The distribution constant type filter further includes another electrically conductive layer Eb provided on the bottom face of the block B for shortcircuiting between one end of each of the inner conductors Eo1 and Eo2 and the outer conductor Es so as to produce $\frac{1}{4}$ wavelength resonance circuits thereby, an input coupling capacitor Ci connected to the other end of the inner conductor Eo1 and formed by providing confronting electrodes Ed1 and Ed2 on a cylindrical dielectric member d1. More specifically, to the other end of the inner conductor Eo1, a fixing member n1 made of an electrically conductive member such as a metallic cylindrical member or electrically conductive paste, is electrically and mechanically connected for securing, with the confronting electrode Ed2 being electrically and mechanically connected to the fixing member n1 for being fixed thereat. Meanwhile, there is also provided an output coupling capacitor Co connected to the other end of the inner conductor Eo2 and formed by providing confronting electrodes Ed3 and Ed4 on a cylindrical dielectric member d2. More specifically, to the other end of the inner conductor Eo2, another fixing member n2 made of electrically conductive member, for example, a metallic cylindrical member or electrically conductive paste in the similar manner as in the fixing member n1, is electrically and mechanically connected for securing, with the confronting electrode Ed4 being electrically and mechanically connected to the fixing member n2 for securing thereat. Thus, the resonance frequency is determined by electrical length of the inner conductor Eo1 or Eo2 shortened by the dielectric constant of the dielectric member B. The electrical length may be of $\frac{1}{4}$ wavelength or $\frac{1}{2}$ wavelength, and in the case of $\frac{1}{2}$ wavelength, the bottom conductive layer Eb is not required. It is to be noted in the drawings, the electrode layers and electrodes, etc. are shown in exaggerated thickness larger than in the actual arrangement for better understanding. Anyhow, in the known arrangement as described so far, two resonance units are constituted, and there is further formed in the dielectric material block B, a cavity V having a cross section, for example, of a circular configuration, and the degree of inductive coupling between the two resonance units depends on the dimensions of said cavity V. The inner peripheral surface of the cavity V is not provided with any electrode layer.

Figure 4:
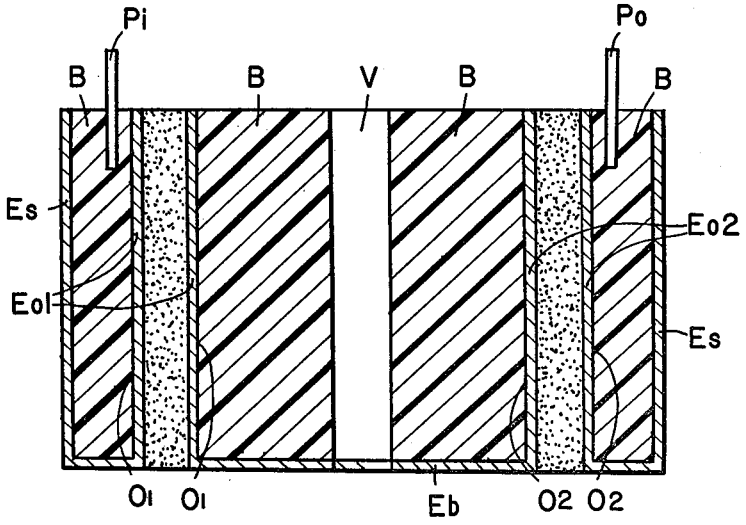
Fig. 4 PRIOR ART

In another example of a prior art distribution constant type filter shown in FIG. 4, the input coupling capacitor Ci and output coupling capacitor Co described as employed in the arrangement of FIGS. 2 and 3 are replaced by an input terminal pin Pi and an output terminal pin Po respectively, with the fixing members n1 and n2 being dispensed with. More specifically, the input terminal pin Pi is embedded in the dielectric material block B in a position remote from the cavity V with respect to the inner conductor Eo1 and close to said layer Eo1, while the output terminal pin Po is similarly embedded in the block B in a position remote from the cavity V with respect to the inner conductor Eo2 and close to said layer Eo2 as shown. Accordingly, an electrostatic capacity at a predetermined degree is formed between the input terminal pin Pi and the inner conductor Eo1, while an electrostatic capacity at a predetermined degree is also present between the output terminal pin Po and the inner conductor Eo2.

Each of the prior art arrangements as described so far, however, has problems in that the construction thereof is rather complicated, with some unstability in functionings, characteristics thereof are not fully satisfactory, troublesome procedures are required for the manufacture and adjustments, and thus, sufficient cost reduction can not be achieved, etc.

Accordingly, an essential object of the present invention is to provide an improved distribution constant type electrical filter which is so arranged that, by inserting columnar or cylindrical dielectric units each having conductive wires axially extended therethrough, into corresponding through-openings formed in a dielectric material block for electrostatic coupling between said conductive wires and inner conductors provided on the inner peripheral faces of said through-openings, the inner conductors on the inner peripheral faces of said through-openings are utilized, for example, as confronting electrodes each at one side of an input coupling capacitor or an output coupling capacitor so as to simplify mounting of such input and output coupling capacitors.

Another important object of the present invention is to provide a distribution constant type filter as described above which is simple in construction and stable in functioning at high reliability, and can be readily manufactured on a large scale at low cost.

A further object of the present invention is to provide a composite filter including a plurality of the distribution constant type filters as described above accommodated in a casing having an improved structure.

In accomplishing these and other objects, according to one preferred embodiment of the present invention, there is provided a distribution constant type filter which includes a dielectric material block made of a dielectric material provided with at least a pair of through-openings formed in the dielectric material block side by side, at a predetermined interval therebetween, inner electrically conductive layers respectively formed on inner peripheral faces of the through-openings, an outer electrically conductive layer provided at least on four side faces of the dielectric material block, and at least a pair of dielectric units each provided with a columnar portion formed by applying a dielectric material onto part of an electrically conductive wire so that the electrically conductive wire axially extends therethrough, and respectively inserted into the through-openings of the dielectric material block for electrostatic coupling between the electrically conductive wires of the dielectric units and the electrically conductive layers so as to form at least a pair of neighboring resonance units thereby.

By the arrangement according to the present invention as described above, an improved distribution constant type filter highly efficient in use has been advantageously presented through simple construction.

Figure 5:
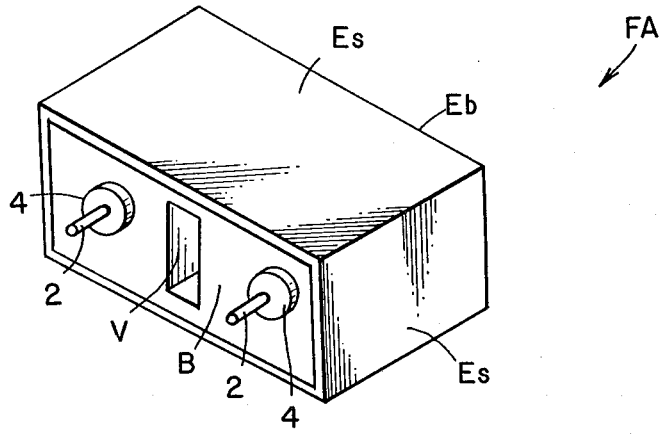
Figure 6:
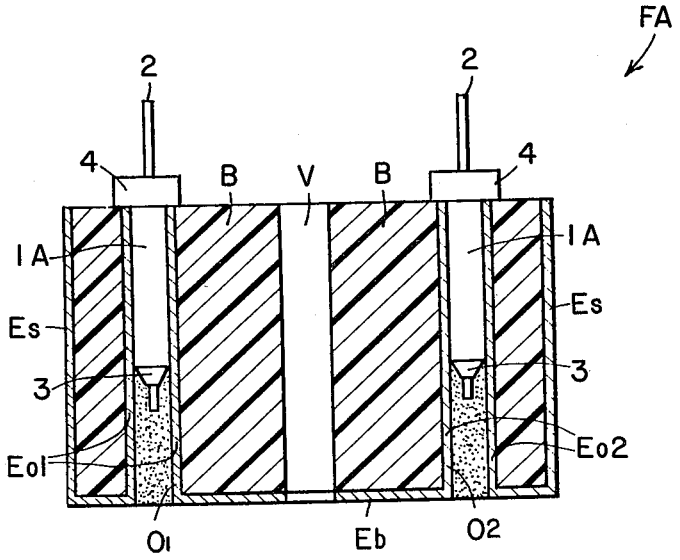
Figure 7:
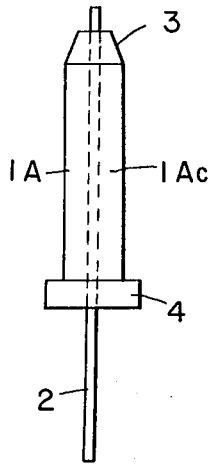
Figure 8:
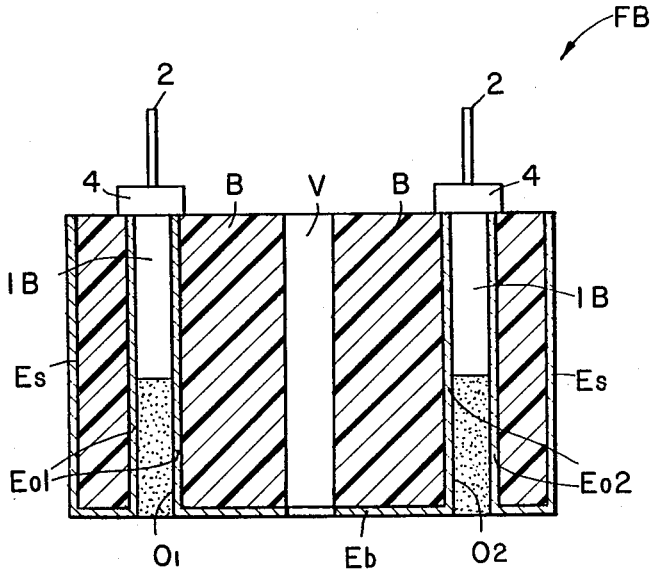
Figure 9:
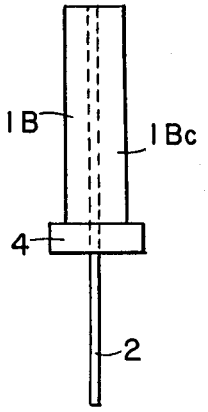
Figure 10:
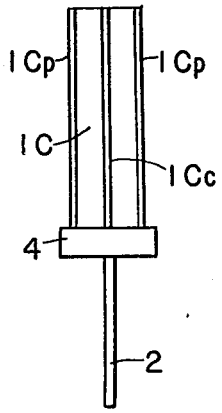
Figure 9:
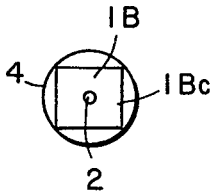
Figure 10:
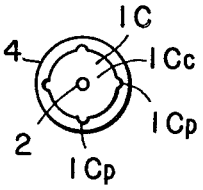
Figure 11:
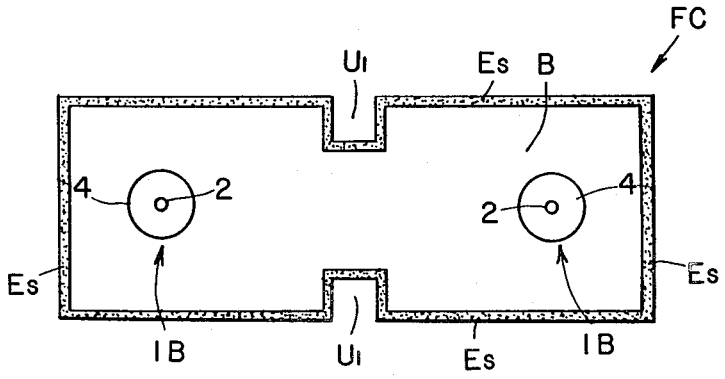
Figure 12:
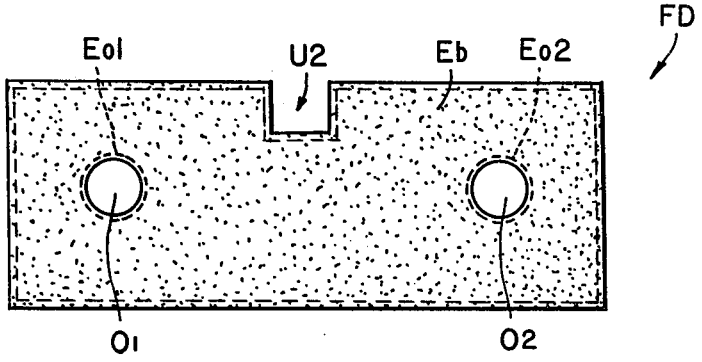
Figure 13:
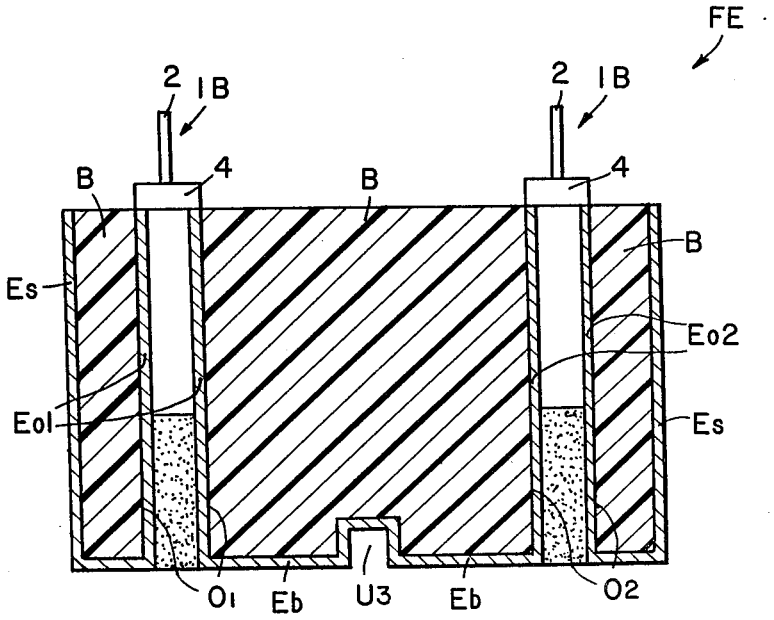
Figure 14:
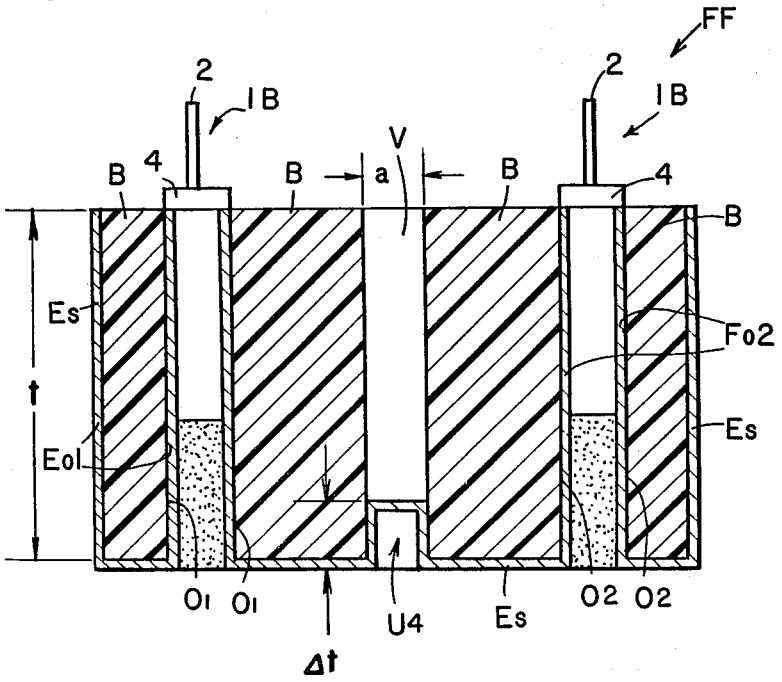
Figure 15:
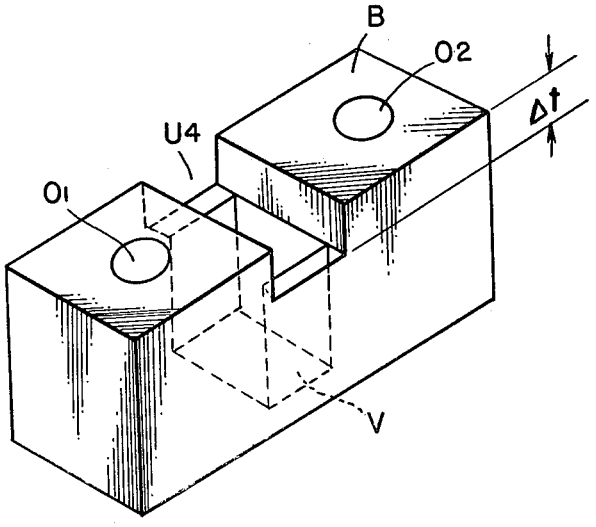
Figure 16:
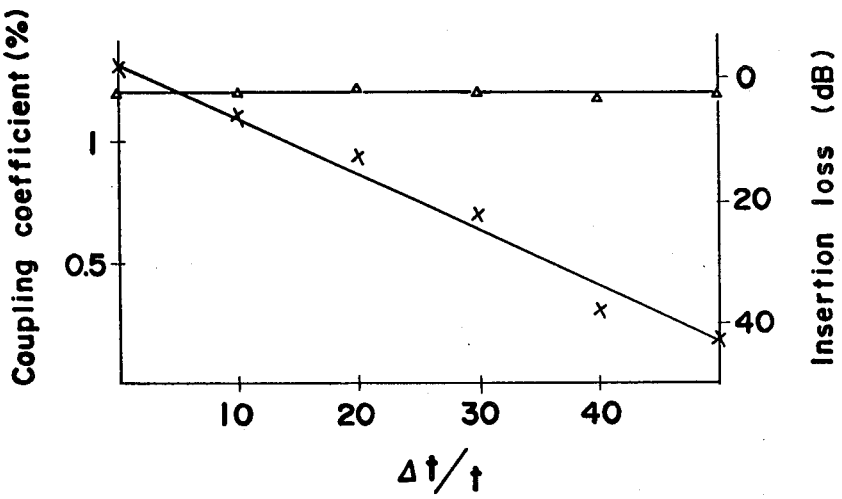
Figure 17:
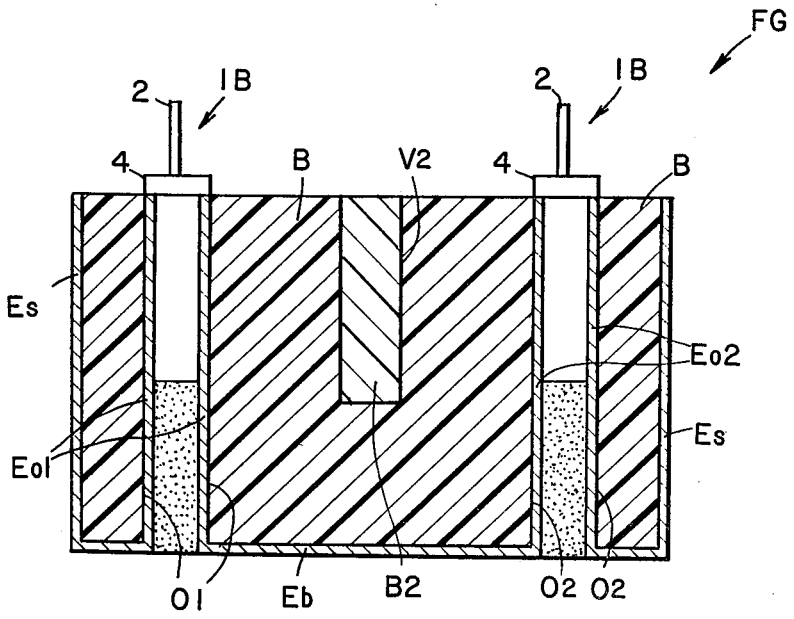
Figure 18:
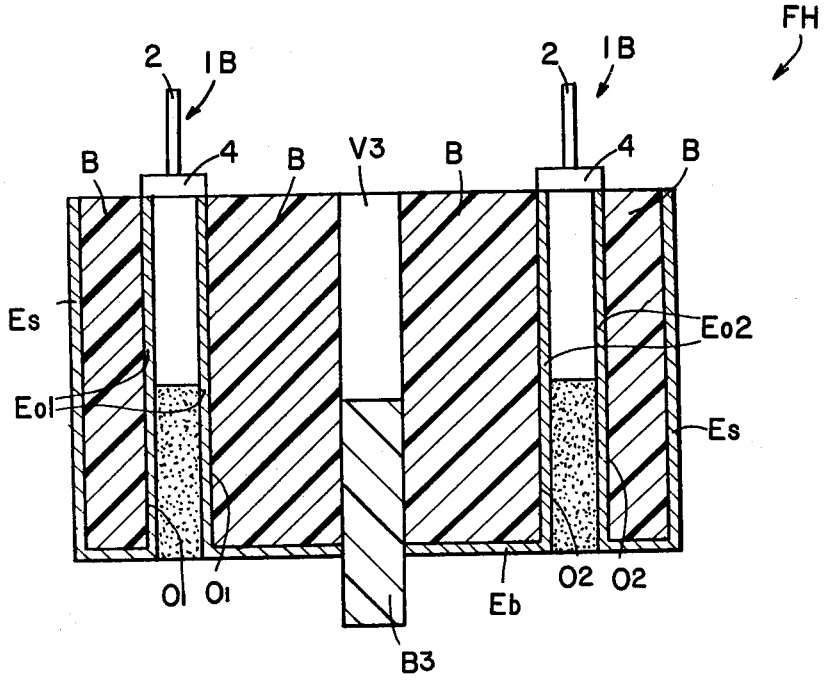
Figure 19:
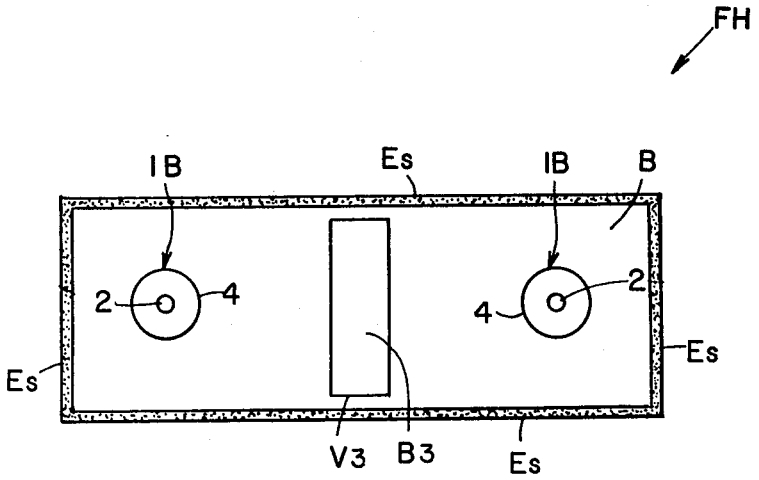
Figure 20:
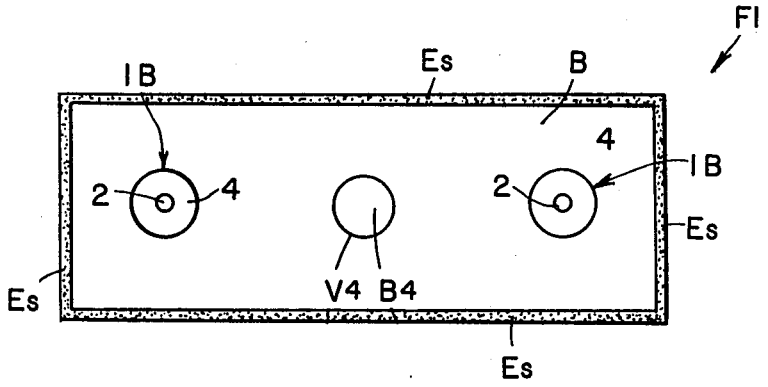
Figure 21:
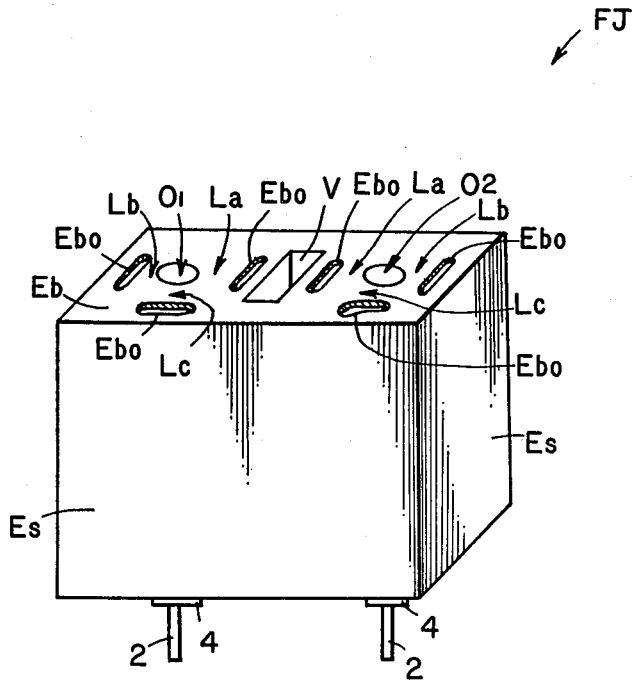
Figure 22:
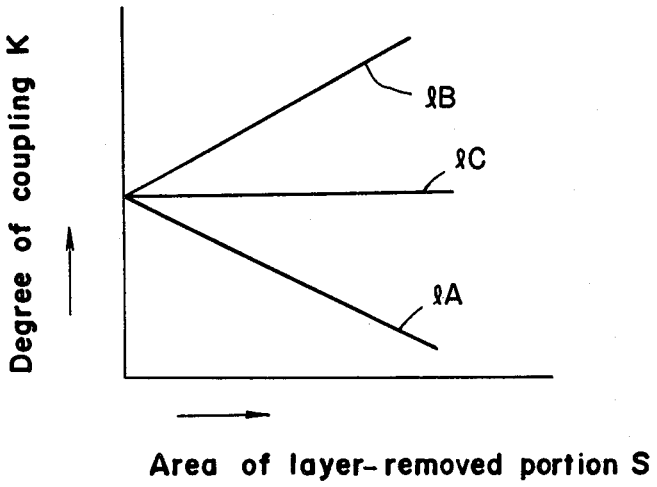
Figure 23:
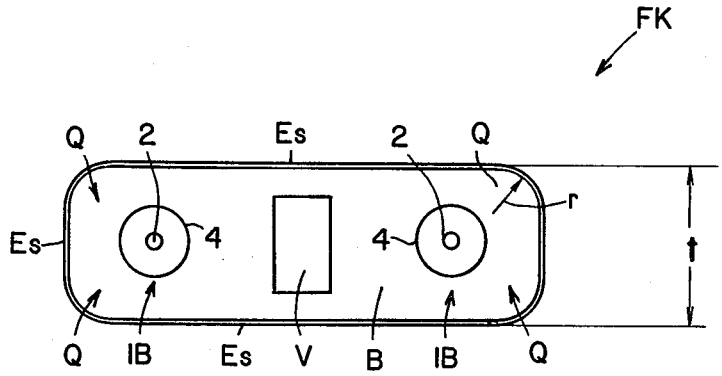
Figure 24:
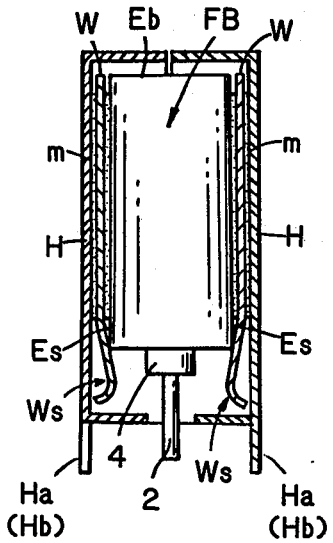
Figure 25:
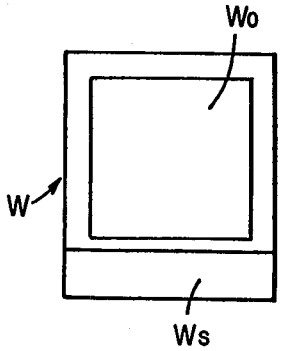
Figure 26:
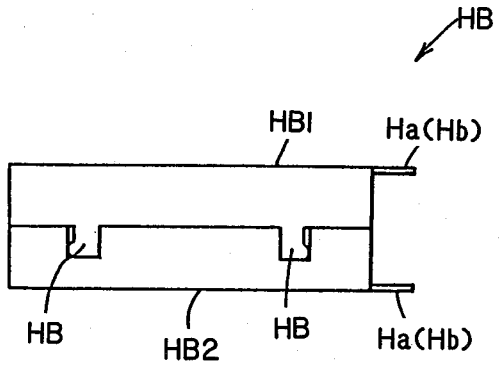
Figure 27:
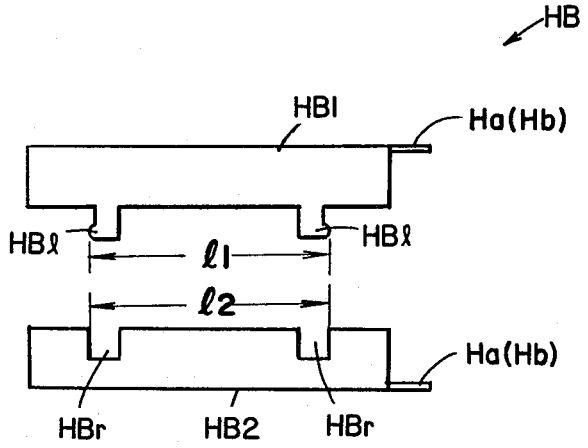
Figure 28:
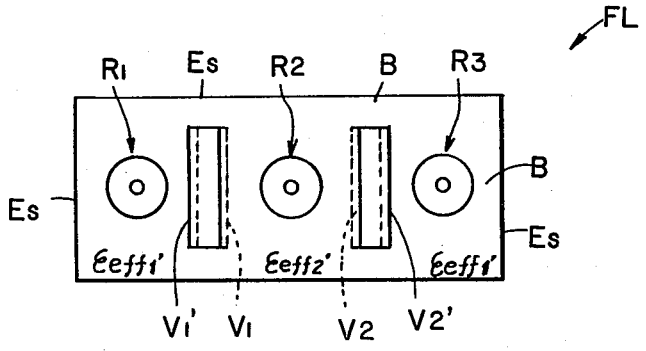
Figure 29:
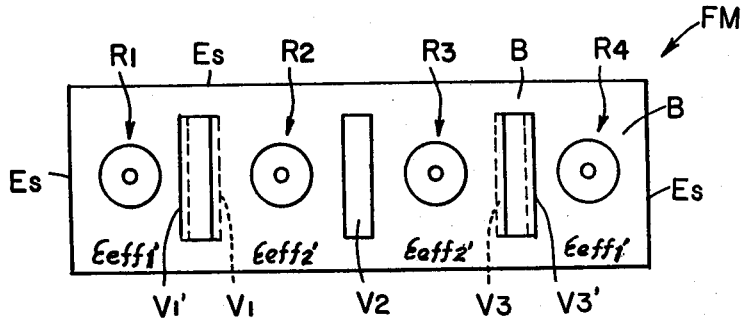
Figure 30:
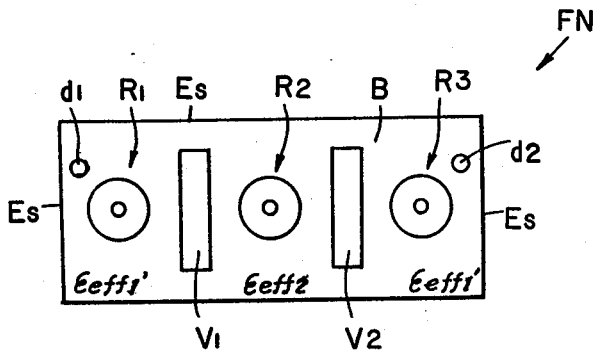
Figure 31:
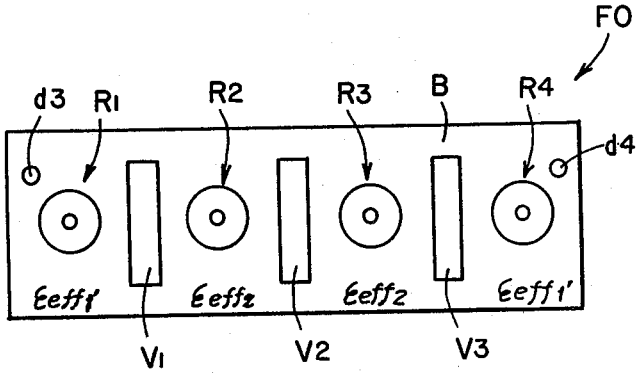
Figure 32:
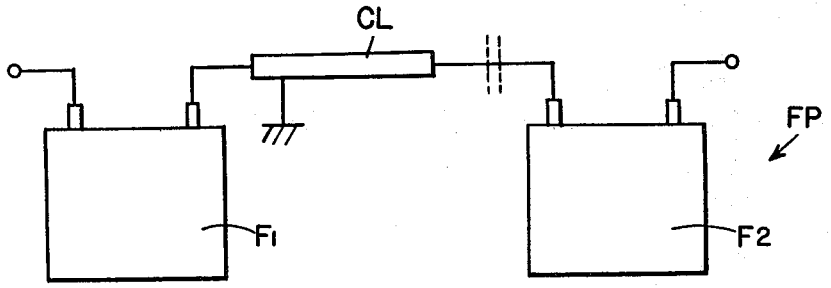
Figure 33:
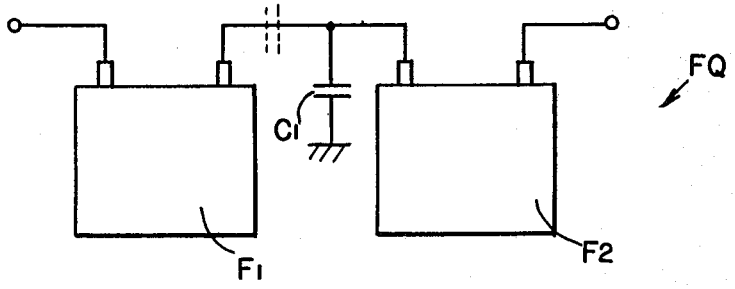
Figure 34:
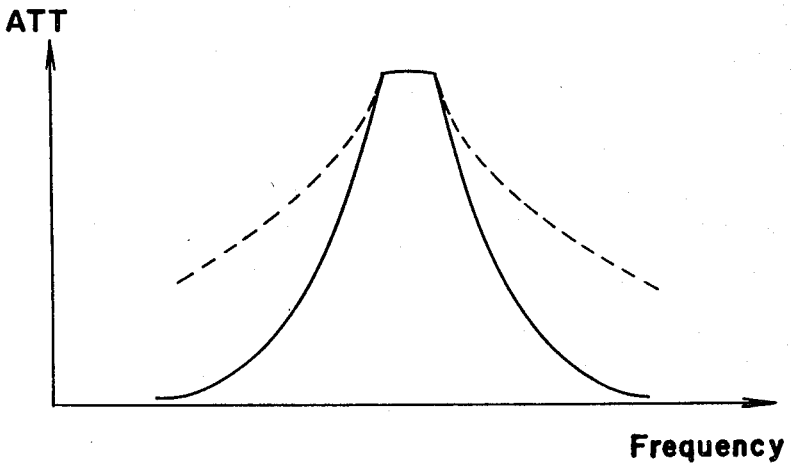
Figure 35:
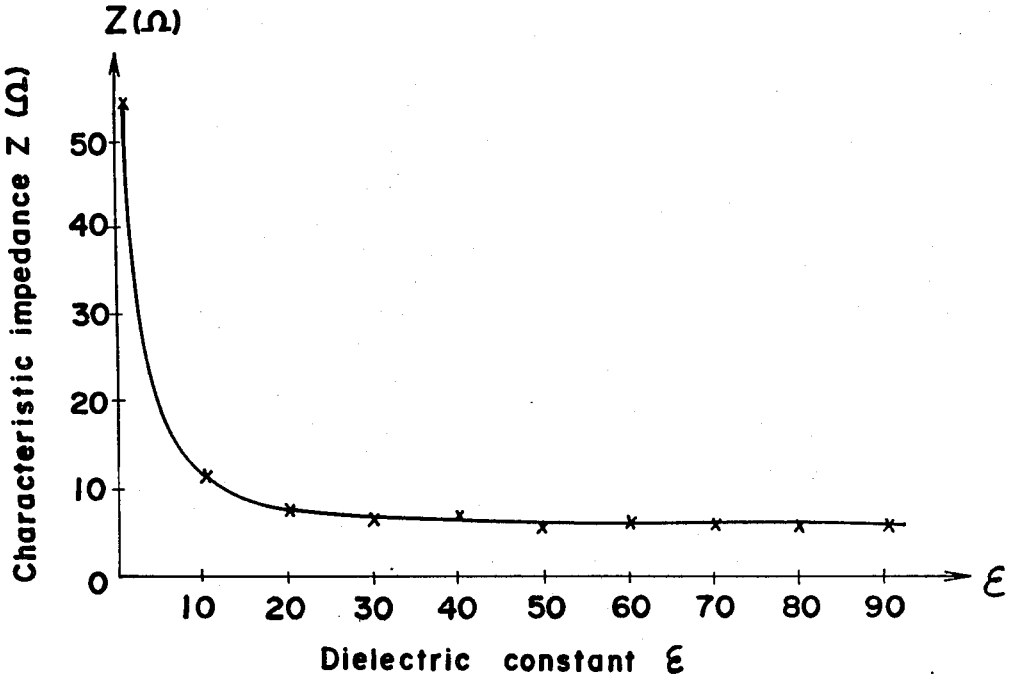
Figure 36:
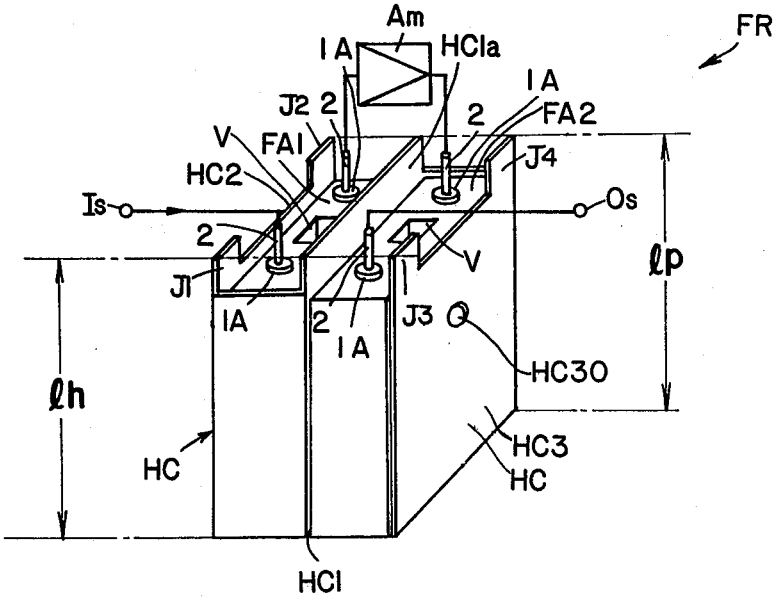
Figure 37:
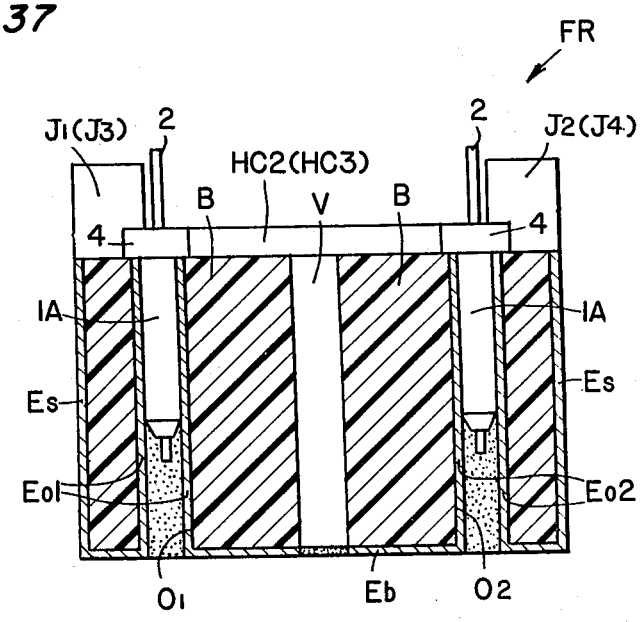
Figure 38:
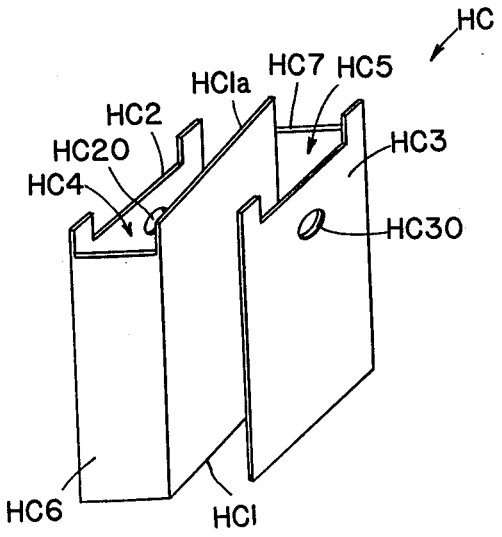

These and other objects and features of the present invention will become apparent from the following description taken in conjunction with the preferred embodiment thereof with reference to the accompanying drawings, in which;

FIG. 1 is an electrical circuit diagram showing a circuit construction of a conventional distribution constant type filter (already referred to), FIG. 2 is a longitudinal sectional view showing one example of a conventional distribution constant type filter (already referred to), FIG. 3 is a top plan view of the filter of FIG. 2, FIG. 4 is a view similar to FIG. 2, which particularly shows another example of a conventional distribution constant type filter (already referred to), FIG. 5 is a perspective view of a distribution constant type filter according to one preferred embodiment of the present invention, FIG. 6 is a longitudinal sectional view of the filter of FIG. 5, FIG. 7 is a side elevational view showing on an enlarged scale, a dielectric unit employed in the filter of FIG. 5, FIG. 8 is a view similar to FIG. 6, which particularly shows a first modification thereof, FIG. 9 (*a*) is a side elevational view showing on an enlarged scale, a dielectric unit employed in the filter of FIG. 8, FIG. 9 (*b*) is a top plan view of the dielectric unit of FIG. 9 (*a*), FIG. 10 (*a*) is a view similar to FIG. 9 (*a*), which particularly shows a modification thereof, FIG. 10 (*b*) is a top plan view of the dielectric unit of FIG. 10 (*a*), FIG. 11 is a top plan view of a distribution constant type filter according to a second modification of the present invention, FIG. 12 is a bottom plan view of a distribution constant type filter according to a third modification of the present invention, FIG. 13 is a longitudinal sectional view of a distribution constant type filter according to a fourth modification of the present invention, FIG. 14 is a longitudinal sectional view of a distribution constant type filter according to a fifth modification of the present invention, FIG. 15 is a perspective view of a dielectric block employed in the filter of FIG. 14, FIG. 16 is a characteristic diagram of the filter of FIG. 14, FIG. 17 is a longitudinal sectional view of a distribution constant type filter according to a sixth modification of the present invention, FIG. 18 is a longitudinal sectional view of a distribution constant type filter according to a seventh modification of the present invention, FIG. 19 is a top plan view of the filter of FIG. 18, FIG. 20 is a top plan view of a distribution constant type filter according to an eighth modification of the present invention, FIG. 21 is a perspective view of a distribution constant type filter according to a ninth modification of the present invention, FIG. 22 is a graph explanatory of the relation between the area of conductive layer removed portions and degree of coupling in the filter of FIG. 21, FIG. 23 is a top plan view of a distribution constant type filter according to a tenth modification of the present invention, FIG. 24 is a side sectional view explanatory of a fixing structure of a dielectric coaxial resonator according to an eleventh modification of the present invention, FIG. 25 is a top plan view of a plate spring employed in the arrangement of FIG. 24, FIG. 26 is a side elevational view of a casing which may be employed in the distribution constant type filter according to the present invention, FIG. 27 is an exploded side elevational view of the casing of FIG. 26, FIG. 28 is a top plan view of a distribution constant type filter according to a twelfth modification of the present invention, FIG. 29 is a view similar to FIG. 28, which particularly shows a thirteenth modification of the present invention, FIG. 30 is a view similar to FIG. 28, which particularly shows a fourteenth modification of the present invention, FIG. 31 is a view similar to FIG. 28, which particularly shows a fifteenth modification of the present invention, FIG. 32 is an electrical block diagram explanatory of a construction of a composite filter according to the present invention, FIG. 33 is a diagram similar to FIG. 32, which particularly shows a modification thereof, FIG. 34 is a graph explanatory of characteristics of the filter of FIG. 32, FIG. 35 is a graph showing the relation between the dielectric coefficient of a dielectric member and characteristic impedance of the resonator, FIG. 36 is a perspective view of a composite filter according to a sixteenth modification of the present invention, FIG. 37 is a longitudinal sectional view of a distribution constant type filter employed in the arrangement of FIG. 36, and FIG. 38 is a perspective view of a casing employed in the arrangement of FIG. 36.

Before the description of the present invention proceeds, it is to be noted that like parts are designated by like reference numerals throughout the accompanying drawings.

Referring now to the drawings, there is shown in FIGS. 5 and 6, a distribution constant type filter FA according to one preferred embodiment, which generally includes a rectangular cubic dielectric material block B made, for example, of a ceramic dielectric material of titanium oxide group and the like, bores or through-openings 01 and 02 formed in the dielectric material block B side by side at a predetermined interval therebetween, inner electrically conductive layers or inner conductors Eo1 and Eo2 respectively formed over the inner peripheral faces of said through-openings 01 and 02, an outer electrically conductive layer or outer conductor Es provided at least on four side faces of said dielectric material block B, another conductive layer Eb provided on the bottom face of the block B for shortcircuiting between the inner conductors Eo1 and Eo2 and the outer conductor Es, and a cavity V formed at a central portion of said block B between the through-openings 01 and 02 in an axial direction thereof. The construction described so far is generally similar to that in the conventional arrangement described with reference to FIGS. 1 through 4 except for the particular constructions according to the present invention as described in detail hereinbelow.

In the distribution constant type filter FA according to the present invention as illustrated in FIGS. 5 and 6, a dielectric unit 1A as shown in FIG. 7 is fitted under pressure into each of the through-openings 01 and 02 formed with the inner conductors Eo1 and Eo2 on the inner peripheral faces thereof as described above.

Each of the dielectric units 1A is provided with a columnar or cylindrical portion 1Ac having, for example, a circular cross section and formed by applying a dielectric material of plastics or ceramics of titanium oxide group and the like, onto part of a conductive wire 2 having a diameter, for example, of 0.5 mmϕ so that said conductive wire 2 axially extends therethrough, and has a taper portion 3 formed at its forward end for facilitation of insertion of said unit 1A into the through-openings 01 and 02 of the dielectric material block B, and also, a flange portion 4, for example, of a circular shape formed at its rear end so as to be brought into contact with a peripheral edge of each of the openings 01 and 02 of the block B where the outer conductor Es is not formed. As shown in FIG. 6, the dielectric units 1A are fitted, from the taper portions 3 thereof, into the openings 01 and 02 of the block B formed with the inner conductors Eo1 and Eo2 until the flange portions 4 of the dielectric units 1A come into contact with the dielectric material block B.

By the arrangement of FIGS. 5 through 7 according to the present invention as described above, the conductive wires 2 of the dielectric units 1A and the inner conductors Eo1 and Eo2 formed on the inner peripheral faces of the through-openings 01 and 02 of the dielectric material block B are electrostatically coupled to each other through the portions of the dielectric material of said dielectric units 1A, and thus, the input coupling capacitor Ci and output coupling capacitor Co described as employed in the conventional arrangement of FIGS. 1 through 4 may be dispensed with, and accordingly, troublesome procedures required for mounting such capacitors Ci and Co, etc. can be eliminated.

It should be noted here that, in the foregoing embodiment, although the present invention has been mainly described with reference to a distribution constant type filter, the concept of the present invention is not limited in its application to such distribution constant type filter alone, but may readily be applied to other high frequency components and parts in general.

It should also be noted here that the cross sectional shape of the columnar portion 1Ac and the configuration of the flange portion 4, etc. are not limited to the circular shape, but may be modified into various configurations such as a square, rectangular, triangular or other polygonal shapes, depending on necessity as described later.

As is clear from the foregoing description, according to the first embodiment of the present invention, since the arrangement is so made that the columnar dielectric units 1A are fitted into the corresponding through-openings 01 and 02 of the dielectric material block B so as to electrostatically couple the conductive wires 2 axially extended through said dielectric units 1A, with the electrically conductive layers Eo1 and Eo2 formed on the inner peripheral faces of the through-openings 01 and 02 of said dielectric material block B, conventionally required input and output coupling capacitors, etc., which involve troublesome procedures for attaching may be eliminated, with significant facilitation of assembly work for high frequency parts applied with the present invention, and consequent reduction in cost.

Referring further to FIGS. 8 to 10 (*b*), there is shown in FIG. 8, a distribution constant type filter FB according to a first modification of the present invention. Since the filter FB of the first modification has the construction and effect generally similar to the filter FA of FIGS. 5 and 6 except that the dielectric unit 1A of the first embodiment is replaced by a dielectric unit 1B having a different cross sectional shape, detailed description of the filter construction is abbreviated here for brevity, with like parts being designated by like symbols and numerals.

In the first modification of FIG. 8, the dielectric unit 1A described as having a circular cross section at its columnar portion 1Ac in FIG. 7 is replaced by the dielectric unit 1B having a square cross section at its columnar portion 1Bc, with the taper portion 3 at its forward end being dispensed with as illustrated in FIGS. 9 (*a*) and 9 (*b*). The dielectric units 1B are similarly fitted into the openings 01 and 02 of the block B formed with the inner conductors Eo1 and Eo2 until the flange portions 4 thereof come into contact with the dielectric material block B.

By the above arrangement of the present invention in FIGS. 8 through 9 (*b*), not only the troublesome procedures required for attaching the input and output capacitors Ci and Co as in the conventional arrangement in FIGS. 1 through 4 are eliminated, but even when the size of the dielectric unit 1B is larger than the diameter of the through-openings 01 and 02 of the dielectric material block B by an error during manufacture or the like, the dielectric unit 1B may be readily inserted into said openings 01 and 02 by scraping of corner portions of the square cross section thereof, although the entire peripheral surface is required to be scraped or cut in the case of a dielectric unit having a circular cross section, with a consequent low working efficiency. From the above point of view, it is needless to say that the cross section of the dielectric unit is not limited to the square configuration, but may be of any polygonal shapes so far as there are provided with corner portions to be scraped off.

In a further modified dielectric unit 1*c* as shown in FIGS. 10 (*a*) and 10 (*b*), the columnar portion 1Cc thereof in a circular cross section is provided, for example, with four axially extending protrusions or raised portions 1Cp each having, for example, a semi-circular cross section, and formed at an interval of 90° on the outer peripheral surface of the columnar portion 1Cc as best shown in FIG. 10 (*b*), although the cross section of the protrusions 1Cp is not limited in the configuration to the semi-circular shape as described above, but may be modified in various ways. By the above structure, the distance between the metallic wire 2 at the center and the peripheral portion of the columnar portion 1Cc is advantageously increased as compared with that in the arrangement of FIG. 9 (*b*), and a sufficient strength may be achieved even when the columnar portion 1Cc is made of ceramic dielectric material.

It is to be noted that in the dielectric units described so far, the configuration of the flange portion 4 may also be modified into various shapes depending on requirements, and that the taper portion 3 at the forward end of the dielectric unit may be provided as in the dielectric unit 1A of FIG. 7 or dispensed with as in the dielectric units 1B and 1C of FIGS. 9 (*a*) and 10 (*a*).

It should also be noted that the concept of the present invention is not limited in its application to the distribution constant type filter FB as shown in FIG. 8 alone, but may be widely applied to high frequency components and parts in general.

In a distribution constant type filter FC according to another modification of the present invention as shown in FIG. 11, the filter, for example, the filter FB of FIG. 8, but not formed with the cavity V, is provided with a pair of recesses U1 at opposite side faces thereof applied with the outer conductor Es. In the above case, the degree of coupling between the resonance units is reduced as compared with the case where such recesses U are not provided. On the contrary, if a recess U2 is formed only at either one of the opposite side faces applied with the outer layer Es as shown in a filter FD according to a further modification of FIG. 12, the degree of coupling between the resonance units is increased as compared with the case where such recess U2 is not provided. In the case where the pair of recesses U1 are provided as in the arrangement of FIG. 11, configurations and dimensions of the both recesses U1 need not be exactly the same. It is to be noted that the above arrangements of FIGS. 11 and 12 are effective for roughly setting the degree of coupling.

For fine adjustment of the degree of coupling, a recess U3 having a predetermined depth in the vertical direction may be provided, for example, at the bottom portion of the distribution constant type filter HB of FIG. 8 without the cavity V as shown in another modified distribution constant type filter FE of FIG. 13. It should be noted that such a recess U3 may be provided not only in the bottom face of the dielectric material block B, but also in an upper face or both in the upper and bottom faces thereof, and that the recess U3 may of course be provided independently or together with the recesses U1 and U2 of FIGS. 11 and 12.

By the arrangement of FIGS. 11 through 13 according to the present invention as described above also, the conductive wires 2 of the dielectric units 1B and the inner conductors Eo1 and Eo2 formed on the inner peripheral faces of the through-openings 01 and 02 of the dielectric material block B are electrostatically coupled to each other through the portions of dielectric material of said dielectric units 1B, and therefore, the input coupling capacitor Ci and output coupling capacitor Co described as employed in the conventional arrangement of FIGS. 1 through 4 may be dispensed with, and thus, troublesome procedures required for mounting such capacitors Ci and Co, etc. can be eliminated.

As is clear from the foregoing description, the distribution constant type filter FC, FD or FE of the above modifications includes the block of dielectric material having at least two through-openings or bores formed therein side by side, at a predetermined interval therebetween, the electrically conductive layers or inner conductors provided over the inner faces of said through-openings, the outer conductor formed at least on four side faces of said dielectric material block and the short-circuiting conductor provided on the bottom face of the block B so as to constitute the resonance units together with the intervening dielectric material, while a recess or recesses are provided in the outer face of the dielectric material block at least between the neighboring pair of the resonance units for setting the degree of coupling between said resonance units. Accordingly, in the above construction according to the present invention, the formation of the electrically conductive layers may be effected in an efficient manner, while simultaneously, since the coupling degree setting range is expanded more than ten times that of the conventional arrangements, filters having various band-pass characteristics can be efficiently produced.

It should be noted here that the number of stages of the resonance units is not limited to two stages as in the foregoing embodiments, but may be increased as desired, while the resonance units may be arranged in an inter-digital form, and also that the conductive layers may be formed after filling the recesses with a dielectric material different from that which constitutes the dielectric material block for increased productivity.

In a distribution constant type filter FF shown in FIG. 14 according to a further modification, for example, of the filter FB of FIG. 8, the dielectric material block B is further formed with a recess or groove U4 provided in the bottom face thereof in a position below the cavity V, for example, of a rectangular cross section (FIG. 15). On the assumption that a width "a" of the rectangular cavity V is set to 2 mm, the state where a ratio of depth of the recess U4/height of the dielectric material block B is varied, is shown in a characteristic diagram of the embodiment according to the present invention in FIG. 16. As is seen from the graph of FIG. 16, as the depth $\Delta t$ of the recess U4 is increased, the coupling coefficient may be reduced without increasing the insertion loss. The tendency as described above also applies to the filters different in the width "a" or in other dimensions.

In FIG. 17, there is shown another modification, for example, of the filter FB of FIG. 8. In the modified distribution constant type filter FG of FIG. 17, the cavity V in the filter FB of FIG. 8 is replaced by a cavity V2 not extending through the dielectric material block B and filled therein with a filling member B2 of a dielectric material different from that of the dielectric material block B so as to set the degree of coupling to a desired value depending on the dielectric constant of the filling member B2 together with the dimensions and configurations of the cavity V2. The dielectric material block B and the filling member B2 may be integrally sintered or may be those separately sintered and combined for the purpose. It should be noted that the cavity V2 may be extended through the block B as in the cavity V in the filter FB of FIG. 8, and that the filling member B2 need not necessarily completely fill the cavity V or V2.

As is seen from the foregoing explanation, the modified distribution constant type filter FD of FIG. 17 also includes the block of dielectric material having at least two through-openings or bores formed therein side by side, at a predetermined interval therebetween, the inner conductors provided over the inner peripheral faces of said through-openings, the outer conductor formed at least on four side faces of said dielectric material block and the shortcircuiting bottom layer so as to constitute resonance units together with the intervening dielectric material, while the cavity is provided in the dielectric material block between at least a pair of neighboring resonance units, with the filling member of a dielectric material different from that of the dielectric material block being filled in said cavity for setting the degree of coupling between the pair of resonance units. Accordingly, in the above construction according to the present invention also, the formation of the electrically conductive layers may be effected in an efficient manner, while simultaneously, since the coupling degree setting range is expanded more than ten times that of the conventional arrangements, filters having various band-pass characteristics can be efficiently produced by the same metal molds.

It should be noted here that, in the above modification also, the number of stages of the resonance units is not limited to two stages, but may be increased as desired, while the resonance units may be arranged in an inter-digital form.

In a further modification as shown in FIGS. 18 and 19, the distribution constant type filter FH is formed with a cavity V3, for example, of a rectangular cross section having a bottom or extended through the dielectric material block B, and a rod or bar B3 made of a dielectric material different from or the same as that of the dielectric material block B is partially inserted into the cavity V3 as shown. In the filter FH as described above, the degree of coupling may be set at a desired value depending on the dielectric constant and depth of insertion of the dielectric bar B3 together with the dimensions and configurations of the cavity V3. After setting of the coupling degree, the bar B3 is secured to the dielectric material block B by a suitable means. The portion of the dielectric bar B3 extending outwardly from the dielectric material block B may be left as it or removed so as to be flush with the surface of the block B. As the depth of insertion of the bar B3 is increased, the bank-pass width may be varied over a range of approximately 0.1 to 2.2% of the center frequency. In the experiments carried out by the present inventors, there has been observed a trend in which, as the bar B3 is inserted, the center frequency is lowered, with a portion at a region higher than the center frequency of a selectivity curve being rapidly shifted towards the lower region, while a portion at a region lower than the center frequency of the selectivity curve is slowly shifted toward the higher region. In other words, as the degree of insertion of the bar B3 is increased, narrower band-pass filters may be obtained.

As described so far, the modified distribution constant type filter FH of FIGS. 18 and 19 comprises the block of dielectric material having at least two through-openings or bores formed therein side by side, at a predetermined interval therebetween, the inner conductors provided over the inner faces of said through-openings, the outer conductor formed at least on four side faces of said dielectric material block and the bottom shortcircuiting electrode so as to constitute resonance units together with the intervening dielectric material, while the cavity having, for example, a rectangular configuration is provided in the dielectric material block between at least a pair of neighboring resonance units, with the bar of a dielectric material being filled in said cavity for setting the degree of coupling between the pair of resonance units. Therefore, in the above construction according to the present invention, the formation of the electrically conductive layers may also be effected in an efficient manner, while, since the coupling degree setting range is expanded more than ten times that of the conventional arrangements, filters having various band-pass characteristics can be efficiently produced by the same metal molds. In the above modification also, the number of stages of the resonance units is not limited to two stages as in the foregoing embodiments, but may be increased as desired, while the resonance units may be arranged in an inter-digital form.

The arrangement of FIGS. 18 and 19 may further be modified as in the distribution constant type filter FI of FIG. 20, in which the cavity V3 described as having the rectangular cross section is replaced by a cavity V4 having a circular cross section, into which a round columnar rod B4 of a dielectric material different from or the same as that of the dielectric material block B is inserted. In this modification also, the degree of coupling may be set to a desired value depending on the dielectric coefficient and depth of insertion of the dielectric rod B4 together with the dimensions of the cavity V4. Since other constructions and effects of the filter FI of FIG. 20 are generally the same as those of the filter FH of FIGS. 18 and 19, detailed description thereof is abbreviated here for brevity.

Referring to FIG. 21, there is shown a distribution constant type filter FJ according to another modification, for example, of a filter FB of FIG. 8, which is particularly arranged to adjust band-pass width thereof in an efficient manner.

More specifically, in the modified distribution constant filter FJ of FIG. 21, the bottom conductive layer Eb which shortcircuits the inner conductors Eo1 and Eo2 formed on the inner peripheral faces of the through-openings O1 and O2 of the dielectric material block B, with the conductive layer Es provided at the side faces of said block B, is removed at several places (six places in this modification) as at layer-removed portions or holes Ebo illustrated in FIG. 21.

When the layer-removed portion Ebo of the shortcircuiting conductive layer Eb is located at a position La between the cavity V and the through-opening 01 or 02, the degree of coupling K is lowered as the area S of the layer-removed portion Ebo is increased, with a consequent narrowing of the band-pass width of the distribution constant type filter FJ as shown by a line lA in a graph of FIG. 22. When the layer-removed portion Ebo is located at a position Lb at the side remote from the cavity V with respect to the through-opening 01 or 02, the degree of coupling increases as the area S of the layer-removed portion Ebo is increased, with a consequent broadening of the band-pass width of the filter FJ as represented by a line lB in FIG. 22. Meanwhile, when the layer removed portion Ebo is located at a position Lc intermediate between the positions La and Lb, the degree of coupling K remains unaltered, even when the area S of the layer-removed portion Ebo is increased as shown by a line lC in the graph of FIG. 22, and thus, the band-pass width of the distribution constant type filter FJ of FIG. 20 is not changed.

By the above arrangement, the band-pass width of any distribution constant type filters may be adjusted as desired by altering the forming positions and area S of the layer-removed portions Ebo in the shortcircuiting conductive layer Eb.

As is clear from the foregoing description, according to the arrangement of the present invention as explained, for example, with reference to the distribution constant type filter FJ of FIG. 21, since it is so arranged that, by removing at desired places, the conductive layer for shortcircuiting the inner conductors formed on the inner peripheral faces of the through-openings of the dielectric material block, with the outer conductor formed on the outer peripheral faces of said dielectric material block, the band-pass width of the distribution constant type filter is properly adjusted, and accordingly, it has been made possible to freely adjust the band-pass widths of distribution constant type filters employing the dielectric material blocks, although such adjustments have been impossible in the conventional practices, and thus, allowance in design of distribution constant type filters has been advantageously broadened, with a consequent reduction in the failure rate of the products, while semi-finished products before measuring the band-pass width may be stocked for shipping through adjustments of band-pass widths after receipt of order.

It is needless to say that the arrangement of the present invention as described above with reference to FIGS. 21 and 22 is not limited in its application, to the filter FJ of FIG. 21 alone, but may readily be applied to any other distribution constant type filters as well, with the same advantages.

Referring further to FIG. 23, there is shown a still another modification of the distribution constant type filter, for example, of the filter FB of FIG. 8.

In the modified filter FK of FIG. 23, four corner portions of the dielectric material block B and consequently, the corresponding corner portions of the outer conductor Es are rounded as at Q.

In the above arrangement, the radius of curvature r of the rounded corners Q should preferably be in a ratio of $r/t=0.2$ to 0.5, when the thickness of the dielectric material block B is represented by t. If the ratio r/t is smaller than 0.2, no appreciable effect is noticed, while on the contrary, if the ratio r/t exceeds 0.5, turbulence in electromagnetic fields tends to take place in the similar manner as in the conventional arrangements.

By the arrangement according to the present invention as described so far with reference to FIG. 23, since the dielectric material block B has its corner portions Q advantageously rounded, said block B is free from formation of chipping or the like. Moreover, the electromagnetic fields in the dielectric material block B are formed to be approximately symmetrically with respect to each of the dielectric units, with almost no turbulence, and thus, the quality factor of the resonance units is improved by about 10% as compared with conventional arrangements.

It is to be noted here that, although the above embodiment of FIG. 13 relates to the case where the $\frac{1}{4}$ wavelength resonator is employed, the present invention may be similarly effected even when a $\frac{1}{2}$ wavelength resonator is adopted.

Referring further to FIGS. 24 and 25, there is shown a fixing or securing arrangement of the filters as described so far. More specifically, in the fixing arrangement as illustrated in FIG. 24, the filter, for example, the distribution constant type filter FB described with reference to FIG. 8 is accommodated in a metallic casing H which may be of a single structure or constituted by two halves for facilitation of manufacture, and plate springs W are interposed between the outer conductor Es of the filter FB and corresponding inner walls of the casing H, with layers m of a bonding agent being further formed therebetween as shown.

More specifically, the casing H has a generally rectangular cubic box-like configuration which is fitted over the filter FB in the direction of thickness of the dielectric material block B thereof, and is provided with lugs Ha and Hb extending downwardly from opposite edges of each side wall of said casing H for connection, for example, to a printed circuit board (not shown) or the like. Each of the plate springs W is formed by blanking a resilient metallic plate of phosphor bronze or the like, for example, into a square shape which may be inserted into the casing H (FIG. 24), with a portion adjacent to its one edge being, for example, curved as shown to form a resilient portion Ws, and is disposed between the casing H and the block B, for example, of the filter FB, with the back face of said resilient portion Ws contacting the outer conductor Es of the block B under pressure and the forward edge of said resilient portion Ws being held in pressure contact with the corresponding inner surfaces of the casing H. Furthermore, except for at least the resilient portions Ws of the plate springs W, the layers m of the bonding agent such as epoxy resin, etc. are formed between the casing H and the block B, so that the outer conductor Es of said block B is electrically conducted to the casing H through the resilient portions Ws of said plate springs W.

When the filter is secured to the casing H by the fixing arrangement according to the present invention as described so far, since the outer conductor Es of the block B is conducted to the casing H through the plate springs W without necessity of employing an electrically conductive bonding agent as in the conventional practices, there is no possibility that poor conduction between the outer conductor Es of the block B and the casing H takes place, and even by the expansion and contraction of the casing H and the dielectric material block B due to temperature variations, the outer conductor Es is kept in conduction with respect to the casing H in a stable state. Furthermore, in the above embodiment, the spring plate W should preferably be formed with a punched hole Wo as shown in FIG. 25 for favorable penetration of the bonding agent m into spaces between the casing H and the block B.

It should be noted here that the resilient portion Ws of the plate spring W may be modified to be formed by folding a portion adjacent to one side edge of the plate spring W, into a V-shaped cross section (not shown) instead of the curved shape as in FIG. 24.

As is seen from the above description, according to the fixing arrangement of the present invention, since the outer conductor of the filter is adapted to be conducted to the casing through the resilient portions of the plate springs, the filter is positively secured to the casing without use of the expensive conductive bonding agent to be deteriorated with time, and thus, fixing structure for distributed constant type filters having a stable characteristics through simple construction has been advantageously presented.

Reference is further made to FIGS. 26 and 27 showing a modification of the casing H as described above, especially intended to positively and readily combine two halves of the casing into one complete casing for efficient assembly during manufacture.

The modified casing HB of FIGS. 26 and 27 includes two halves or counterparts HG1 and HB2 thereof, and one half HB1 is formed with lugs HBl extending outwardly from side edges thereof, while the other half HB2 has notches or recesses HBr formed in the side edges thereof corresponding in positions to said lugs HBl. Since a distance l1 between the lugs HBl is arranged to be slightly larger than a distance l2 between the notches HBr, when the notches HBr are engaged with the lugs HBl, friction is produced between the lugs HBl and notches HBr due to pressure contact therebetween, and thus, there is no possibility that the two halves HB1 and HB2 are separated, even without employing any fixing member for holding them together.

It should be noted here that, instead of providing on the lugs HBl on the one half HB1, with only the corresponding notches HBr being formed in the other half HB2 of the casing HB as in the above arrangement, if it is so modified that such lugs HBl are formed on one side edge, with the notches HBr being formed on the other side edge of each of the two halves HB1 and HB2, both of said two halves come to have the same construction, and thus, only one type of metal molds may be advantageously utilized for the manufacture. It should also be noted that the lugs HBl and notches HBr are not limited in the configurations thereof so far as they are capable of producing frictional force therebetween when engaged. As is understood from the foregoing description, in the modification of FIGS. 26 and 27, the lugs HBl are provided in the one half, with the corresponding notches HBr being formed in the other half of the casing divided at least into two portions so as to produce a contact pressure force in the direction of the flat surface of each lug, between the lugs and notches when engaged with each other, and thus, efficient and positive assembly of filters may be achieved during manufacture.

Referring to FIGS. 28 and 29, there are shown further modifications, for example, of the distribution constant type filter FB of FIG. 8, which relate to distribution constant type filters having three stages and more, and are intended to make the effective dielectric constant of each of the resonators into agreement with each other.

In the modification of FIG. 28, the modified distribution constant type filter FL includes another resonator R3 in addition to the two resonators provided, for example, in the filter FB of FIG. 8 and denoted by symbols R1 and R2 in FIG. 28, with coupling degree adjusting cavities V1 and V2 being formed between the resonators R1 and R2, and R2 and R3 respectively. In the above arrangement, when the cavity V1 is gradually displaced towards the resonator R1, and the cavity V2 towards the resonator R3 respectively, there are positions where the existing effective dielectric constant $\epsilon$eff1 becomes $\epsilon$eff1' ($\epsilon$eff1 > $\epsilon$eff1') and the existing effective dielectric constant $\epsilon$eff2 becomes $\epsilon$eff2' ($\epsilon$eff2 < $\epsilon$eff2') so as to establish the relation $\epsilon$eff1' = $\epsilon$eff2'. In FIG. 28, the coupling degree adjusting cavities provided in such displaced positions are represented by symbols V1' and V2' respectively.

Meanwhile, in the modified filter FM having four stage of resonators R1, R2, R3 and R4, when the existing coupling degree adjusting cavities V1 and V3 are respectively displaced towards the resonators R1 and R4, there are positions where the existing dielectric constant $\epsilon$eff1 becomes $\epsilon$eff1' ($\epsilon$eff1 > $\epsilon$eff1') and the existing dielectric constant $\epsilon$eff2 becomes $\epsilon$eff2' ($\epsilon$eff2 < $\epsilon$eff2') for establishing the relation $\epsilon$eff1' = $\epsilon$eff2'. In FIG. 29, the coupling degree adjusting cavities provided in such displaced positions are represented by symbols V1' and V3' respectively.

As described above, the arrangements of FIGS. 28 and 29 are effective for filters having three stages and more.

It should be noted here that in the above arrangement, the coupling degree adjusting cavities to be displaced may be selected as desired according to the requirements, and also that the present invention is applicable not only to the distribution constant type filter of comb-line type as in the above embodiments of FIGS. 28 and 29, but also to distribution constant type filters of inter-digital type as well.

As is seen from the foregoing description, according to the present invention, in the distribution constant type filter which includes more than three cylindrical through-openings formed in the dielectric material block at a predetermined interval therebetween, the inner conductors formed in the inner peripheral faces of the respective through-openings, the outer conductor formed on the side faces of the dielectric material block surrounding said through-openings, the bottom short-circuiting conductor, and coupling degree adjusting cavities formed in the dielectric material block in positions between the inner conductors for induction coupling of the plurality of coaxial resonators, the effective dielectric constants of the respective resonators are adapted to coincide or agree with each other by altering positions of the coupling degree adjusting cavities, and therefore, it is possible to bring the effective dielectric constant of each of the resonators into agreement through simple procedure without necessity, for example, for forming concave and convex portions in the dielectric material block or altering part of the material thereof. Furthermore, from a further advanced point of view, by positively altering the positions of the coupling degree adjusting cavities, the effective dielectric constants for the respective resonators may be determined to any desired values different from each other.

In FIGS. 30 and 31, there are shown further modifications of the arrangements of FIGS. 28 and 29.

In the modified filter FN of three stages as shown in FIG. 30, there are formed holes d1 and d2 at opposite corner portions of the dielectric material block B in positions adjacent to the resonators R1 and R3. By the positions, dimensions, and configurations, etc. of these holes d1 and d2, the effective dielectric constants $\epsilon$eff1 of the resonators R1 and R3 at the first and third stages are altered into $\epsilon$eff1' ($\epsilon$eff1' < $\epsilon$eff1) so as to be in agreement with the effective dielectric constant $\epsilon$eff2 of the dielectric material for the resonator R2 at the second stage. Each of the holes d1 and d2 may be of a through-hole or a hole with a bottom, or may be further replaced by a recess such as a groove or the like.

Meanwhile, in the modified filter FO of four stages as shown in FIG. 31, holes d3 and d4 are similarly formed at opposite corner portions of the dielectric material block B in positions adjacent to the resonators R1 and R4. By the positions, dimensions, and configurations, etc. of these holes d3 and d4, the effective dielectric constants $\epsilon$eff1 of the resonators R1 and R4 at the first and fourth stages are altered into $\epsilon$eff1' ($\epsilon$eff1' < $\epsilon$eff1) so as to be in agreement with the effective dielectric constant $\epsilon$eff2 of the dielectric material for the resonators R2 and R3 at the second and third stages.

It is to be noted here that in the embodiments of FIGS. 30 and 31, although the holes are provided in the dielectric material for the resonators at the first and last stages, it is possible to form holes in the dielectric material for other resonators.

It should also be noted that the above arrangements of FIGS. 30 and 31 are similarly applicable not only to the distribution constant type filter of comb-line type as in the above embodiments but also to distribution constant type filters of inter-digital type.

As is seen from the foregoing description, according to the embodiment of FIGS. 30 and 31, in the distribution constant type filter which includes more than three cylindrical through-openings formed in the dielectric material block at a predetermined interval therebetween, the inner conductors formed in the inner peripheral faces of the respective through-openings, the outer conductor formed on the side faces of the dielectric material block surrounding said through-openings, the bottom shortcircuiting conductor, and coupling degree adjusting cavities formed in the dielectric material block in positions between the inner conductors for induction coupling of the plurality of coaxial resonators, the effective dielectric constants of the respective resonators are adapted to coincide or agree with each other by providing the holes or recesses for the adjustment of the effective dielectric constants, apart from the coupling degree adjusting cavities, and therefore, it is possible to bring the effective dielectric constants of each of the resonators into agreement through simple procedure without necessity for forming concave and convex portions in the dielectric material block or for altering part of the material thereof. Furthermore, as considered from a further advanced point of view, by positively utilizing the holes or recesses, the effective dielectric constants for the respective resonators may be determined to any desired values different from each other.

Referring to FIGS. 32 and 33, there are shown still further modifications in which a plurality of filters, for example, the filters FB of FIG. 8 are coupled or combined to each other to constitute a composite filter.

In the first place, it should be noted that the distribution constant type filters to be applied to the arrangement of FIGS. 32 and 33 are particularly required to employ resonators with a dielectric material having dielectric constant higher than 15 for shortening the electrical length of the resonators.

In the composite filter Fp of FIG. 32, the two-staged distribution constant type filters F1 and F2 each employing two resonators with a dielectric material having dielectric constant higher than 15, are connected in series to each other through a coaxial line CL set in its length to provide desired phase and amount of reflected waves, and the characteristics thereof are shown by a solid line in a graph of FIG. 34. In FIG. 34, the band-pass filter characteristics shown in a dotted line are the characteristics of one filter of the stage, and since two filters having such characteristics as shown by the dotted line are coupled to each other as in FIG. 32 with the turbulence in the characteristics thereof compensated, favorable characteristics equivalent to those of a filter preliminarily designed as a four staged filter have been achieved as represented by the solid line in FIG. 34.

The above arrangement of FIG. 32 may further be modified as in a composite filter FQ in FIG. 33, in which a line connecting the output side of the filter F1 and the input side of the filter F2 is grounded through a capacitor C1 for eliminating an unnecessary response. More specifically, upon alteration of the value of the capacitor C1, phase and amount at a reflecting point are varied, thereby to achieve a proper matching, and as a result, the unrequired response may be eliminated. It is to be noted here that in each of the arrangements of FIGS. 32 and 33, a capacitor may be inserted in series in the line connecting the output side of the filter F1 and the input side of the filter F2 as shown in dotted lines in FIGS. 32 and 33.

In the composite filters FP and FQ of FIGS. 32 and 33, since the resonators shortened in the electrical length through employment of the dielectric material having the dielectric constant higher than 15 are used, the characteristic impedance of the resonators is extremely lowered as shown in a graph of FIG. 35, and accordingly, even when the constant of the components connected to the resonators are deviated to a certain extent, turbulence of impedance on the entire circuit is not easily produced, and thus, characteristics as desired may be readily achieved.

As is seen from the foregoing description, according to the arrangement of FIGS. 32 and 33, owing to the employment of the filters each having a plurality of resonators shortened in the electrical length through adoption of the dielectric material with the dielectric constant higher than 15, the filters finished to have proper filter characteristics, one by one, may be coupled to each other without employing a buffer means therebetween, and accordingly, advantages as follows can be obtained.

(i) By connecting a plurality of inexpensive filters which may be readily designed, characteristics similar to a multi-stage filter may be obtained.

(ii) Since designing is more readily effected than in the conventional filters which have been designed by taking into account, mutual actions between a plurality of filters, the multi-stage filters may be obtained quickly at low cost.

(iii) In the case where filters are to be incorporated into a communication equipment and the like, combination of compact-sized filters of two stage or so, accommodated in individual cases may be employed according to the present invention, although in the conventional arrangements, filters are collected in one casing, and therefore, not only the designing of the filters, but lay-out of the components in the apparatus for incorporation thereof may be facilitated.

(iv) In a case where, for example, one hundred four-staged filters are produced in the conventional arrangements, two-hundred two-staged filters are to be produced for combination, two pieces by two pieces, according to the present invention, and thus, effect for mass production may be achieved, with a consequent reduction in cost.

Referring to FIGS. 36 through 38, there is shown in FIG. 36 a further modification of the composite filters of FIGS. 32 and 33, in which two distribution constant type filters, for example, in the type of the filter FA described earlier with reference to FIG. 6, are accommodated in a modified casing in the manner as described hereinbelow.

In the composite filter FR of FIG. 36, the distribution constant type filters FA1 and FA2 are accommodated in a casing HC, and coupled to input and output sides of a high frequency amplifier Am respectively as shown.

As shown in FIG. 38, the casing HC formed by folding a metallic plate of aluminum, duralumin, brass or copper, etc. into a generally S-shaped, includes a recess HC4 provided at one side of a central partition wall HC1, between said partition wall HC1 and a holder plate portion HC2 for holding therein the filter FA1, and another recess HC5 provided at the other side of the partition wall HC1, between said partition wall HC1 and a holder plate portion HC3 for accommodating therein the other filter FA2.

More specifically, the holder plate portion HC2 is folded to form an angle smaller than 90° with respect to a support portion HC6 which is folded approximately at right angles to said partition wall HC1 so as to hold the filter FA1 in the recess HC4 formed between the holder plate portion HC2 and the partition wall HC1 by inserting said filter FA1 thereinto under pressure for being positively supported by the spring force of the holder plate portion HC2.

Depending on necessity, an opening HC2O may be formed in the holder plate portion HC2 so as to connect the outer conductor Es of the filter FA1 with said holder plate portion HC2 by pouring solder (not shown) through the opening HC2O.

In the similar manner, the holder plate portion HC3 is folded to form an angle smaller than 90° with respect to a support portion HC7 which is folded approximately at right angles to said partition wall HC1 so as to hold the filter FA2 in the recess HC5 formed between the holder plate portion HC3 and the partition wall HC1 by inserting said filter FA2 thereinto under pressure for being positively supported by the spring force of the holder plate portion HC3.

Depending on requirement, another opening HC3O may be formed in the holder plate portion HC3 so as to connect the outer conductor Es of the filter FA2 with said holder plate portion HC3 by pouring solder (not shown) through the opening HC3O.

It is to be noted that both of the filters FA1 and FA2 may be bonded to the casing HC by a suitable bonding agent.

As shown in FIG. 36, when the filters FA1 and FA2 are accommodated in the casing HC, the partition wall HC1 also functions as a shielding plate for shielding the filters FA1 and FA2 separately from each other, but for more positive shielding between said distribution constant type filters FA1 and FA2, an upper portion HC1a of the partition wall HC1 is arranged to extend upwardly from the upper part of the casing HC. Meanwhile, at opposite side edges of each of the holder plate portions HC2 and HC3, protrusions or lugs J1 and J2 and J3 and J4 are provided so as to be inserted into corresponding openings formed in a circuit board (not shown) for mechanical securing. In the arrangement of FIG. 36, a length lp between the lower edge of the partition wall HC1 and the upper edge of the upper portion HC1a thereof is arranged to be equal to a distance lh between the lower edges of the holder plate portions HC2 and HC3 and the upper edges of the lugs J1 and J2 and J3 and J4 thereof.

It is needless to say that, in the arrangement of FIG. 36, the distribution constant type filters FA1 and FA2 described as accommodated in the casing HC for one example, may be replaced by other types of filters. It should also be noted that, for example, the dielectric units 1A may be replaced by other types of dielectric units or by the connection between the inner conductors Eo1 and Eo2 and an external circuit, through an ordinary capacitor, for example, through columnar dielectric members having electrodes formed on the confronting main flat faces thereof, and that the number of stages of the filter may be determined as desired.

As is clear from the above description, according to the arrangement of FIGS. 36 to 38, in each of the plurality of the recesses formed in one casing folded into S-shape, there are respectively inserted under pressure, the distribution constant type filter as described so far, and therefore, the plurality of filters may be housed in one casing, and since these filters are shielded from each other by the partition wall formed by a part of the casing, a composite filter compact in size and not requiring any separate shielding plate, and also easy in handling, has been advantageously presented.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A distribution constant type filter which comprises a dielectric material block member made of a dielectric material provided with at least a pair of through-openings formed in said dielectric material block member side by side, at a predetermined interval therebetween, inner electrically conductive layers respectively formed on inner peripheral faces of said through-openings, an outer electrically conductive layer provided at least on four side faces of said dielectric material block member so as to form at least a pair of neighboring resonance units thereby, and at least a pair of dielectric units each provided with a columnar portion formed by applying a dielectric material onto part of an electrically conductive wire so that said electrically conductive wire axially extends therethrough, and respectively inserted into said through-openings of said dielectric material block member for electrostatic coupling between said electrically conductive wires of the dielectric units and said inner electrically conductive layers.

2. A distribution constant type filter as claimed in claim 1, further including another electrically conductive layer so provided on said electric material block member as to shortcircuit said inner electrically conductive layers with said outer electrically conductive layer.

3. A distribution constant type filter as claimed in claim 1, wherein said dielectric material block member is further provided with a cavity means formed between at least the pair of neighboring resonance units for setting degree of coupling therebetween.

4. A distribution constant type filter as claimed in claim 3, wherein said cavity means is a cavity formed to extend through said dielectric material block member in an axial direction of said through-openings.

5. A distribution constant type filter as claimed in claim 4, wherein said cavity has a circular cross section.

6. A distribution constant type filter as claimed in claim 4, wherein said cavity has a rectangular cross section.

7. A distribution constant type filter as claimed in claim 4, wherein said cavity has a dielectric material rod partially inserted thereinto for adjusting degree of coupling between at least said pair of neighboring resonance units.

8. A distribution constant type filter as claimed in claim 3, wherein said cavity means is a cavity formed not to extend through said dielectric material block member, in an axial direction of said through-openings.

9. A distribution constant type filter as claimed in claim 8, wherein said cavity has a circular cross section.

10. A distribution constant type filter as claimed in claim 8, wherein said cavity has a rectangular cross section.

11. A distribution constant type filter as claimed in claim 8, wherein said cavity has a dielectric material rod filled therein for setting degree of coupling between at least said pair of neighboring resonance units.

12. A distribution type filter as claimed in claim 3, wherein said cavity means is a recess formed in one of the confronting side faces of said dielectric material block member.

13. A distribution constant type filter as claimed in claim 3, wherein said cavity means is recesses formed in the confronting side faces of said dielectric material block member.

14. A distribution constant type filter as claimed in claim 3, wherein said cavity means is a recess formed in a bottom portion of said dielectric material block member so as to have a depth in a vertical direction thereof.

15. A distribution constant type filter as claimed in claim 3, wherein said cavity means is a recess formed in an upper portion of said dielectric material block member so as to have a depth in a vertical direction thereof.

16. A distribution constant type filter as claimed in claim 3, wherein said cavity means is recesses formed both in a bottom and an upper portion of said dielectric material block member so as to have a depth in a vertical direction thereof.

17. A distribution constant type filter as claimed in claim 3, wherein said cavity means includes a cavity formed in said dielectric material block member in an axial direction of said through-openings, and a recess further formed in said dielectric material block member in a position below said cavity.

18. A distribution constant type filter as claimed in claim 1, wherein said dielectric material block member has a cubic rectangular box-like configuration, with vertical four corner edges thereof being rounded at a predetermined radius of curvature.

19. A distribution constant type filter as claimed in claim 1, wherein said columnar portion of each of said dielectric units has a circular cross section.

20. A distribution constant type filter as claimed in claim 1, wherein said columnar portion of each of said dielectric units has a square cross section.

21. A distribution constant type filter as claimed in claim 1, wherein said columnar portion of each of said dielectric units has a polygonal cross section.

22. A distribution constant type filter as claimed in claim 1, wherein said columnar portion of each of said dielectric units has a circular cross section, with four axially extending protrusions being further formed on the outer peripheral surface of said columnar portion at an interval of 90°, each of said four axially extending protrusions having a semi-circular cross section.

23. A distribution constant type filter as claimed in claim 2, wherein said another electrically conductive layer for shortcircuting between said inner electrically conductive layers with said outer electrically conductive layer is formed with layer-removed portions so as to alter the degree of coupling between said resonator units for adjustment of band-pass width of said filter.

24. A distribution constant type filter as claimed in claim 3, further including another through-opening and another cavity means formed in said dielectric material block member, and another dielectric unit inserted into said another through-opening so as to form a three-stage distribution constant type filter having first, second and third resonators, said cavity means for adjusting degree of coupling between said resonators, respectively provided between said first and second resonators, and between said second and third resonators being provided in such positions as to bring effective dielectric constants of the respective resonators into agreement with each other.

25. A distribution constant type filter as claimed in claim 2, further including another plurality of through-openings and another plurality of cavity means formed in said dielectric material block member, and another plurality of dielectric units inserted into said another plurality of through-openings so as to form a multi-stage distribution constant type filter having at least first, second, third and fourth resonators, said cavity means for adjusting degree of coupling between said resonators, respectively provided between said first and second resonators, and between said third and fourth resonators being provided in such positions as to bring effective dielectric constants of the respective resonators into agreement with each other.

26. A distribution constant type filter as claimed in claim 3, further including another through-opening and another cavity means formed in said dielectric material block member, and another dielectric unit inserted into said another through-opening so as to form a three-stage distribution constant type filter having first, second and third resonators, said cavity means for adjusting degree of coupling between said resonators, being respectively provided between said first and second resonators, and between said second and third resonators, said dielectric material block member being further provided with opening means formed therein for adjustmenr of effective dielectric constants so as to bring the effective dielectric constants of the respective resonators into agreement with each other.

27. A distribution constant type filter as claimed in claim 3, further including another plurality of through-openings and another plurality of cavity means formed in said dielectric material block member, and another plurality of dielectric units inserted into said another plurality of through-openings so as to form a multi-stage distribution constant type filter having at least first, second, third and fourth resonators, said cavity means for adjusting degree of coupling between said resonators being respectively provided between said first and second resonators, and between said third and fourth resonators, said dielectric material block member being further provided with opening means formed therein for adjustment of effective dielectric constants so as to bring the effective dielectric constants of the respective resonator into agreement with each other.

28. A distribution constant type filter as claimed in claim 1, further comprising a second distribution constant type filter of the same construction which is connected at its input side to an output side of the first distribution constant type filter through a high frequency amplifier so as to constitute a composite filter, said first and second distribution constant type filters being accommodated in a casing, said casing being formed by folding a metallic plate into a generally S shape, with a first recess for accommodating therein said first distribution constant type filter being formed at one side of a central partition wall thereof in a position between said central partition wall and a first holder plate portion extending therefrom through a first support portion integral with said central partition wall and said first holder plate portion, and with a second recess for accommodating therein said second distribution constant type filter being formed at the other side of the central partition wall thereof in a position between said central partition wall and a second holder plate portion extending therefrom through a second support portion integral with said central partition wall and said second holder plate portion, said first holder plate portion being folded to form an angle smaller than 90° with respect to the first support portion which is folded approximately at right angles to said central partition wall so as to hold said first filter in said first recess formed between said first holder plate portion and said central partition wall by inserting said first filter thereinto under pressure for being positively supported by spring force of said first holder plate portion, with said second holder plate portion being also folded to form an angle smaller than 90° with respect to said second support portion which is folded approximately at right angles to said central partition wall so as to hold said second filter in said second recess formed between said second holder plate portion and said central partition wall by inserting said second filter thereinto under pressure for being positively supported by spring force of said second holder plate portion.

29. A distribution constant type filter as claimed in claim 28, wherein each of said first and second holder plate portions of said casing is formed with an opening for pouring solder therethrough for soldering between said first and second holder plate portions with said outer electrically conductive layer of said first and second distribution constant type filters.

* * * * *